US005522916A

United States Patent [19]

Karinthi et al.

[11] Patent Number: 5,522,916

[45] Date of Patent: Jun. 4, 1996

[54] METHOD AND APPARATUS FOR INJECTING LIQUID OXYGEN

[75] Inventors: Pierre Karinthi, Jouy en Josas; Marc Buffenoir, Voisins le Bretonneux; Eric Streicher, Viroflay, all of France

[73] Assignee: L'Air Liquids, Societe Anonyme pour L'Etude et L'Exploitation des Procedes Georges Claude, Paris Cedex, France

[21] Appl. No.: 325,449

[22] PCT Filed: Feb. 28, 1994

[86] PCT No.: PCT/FR94/00223

§ 371 Date: Oct. 31, 1994

§ 102(e) Date: Oct. 31, 1994

[87] PCT Pub. No.: WO94/20642

PCT Pub. Date: Sep. 15, 1994

[30] Foreign Application Priority Data

Mar. 3, 1993 [FR] France ..... 93 02451

[51] Int. Cl.[6] ..... C21B 7/16; C21B 5/00

[52] U.S. Cl. ..... 75/414; 75/460; 75/466; 266/221; 266/268

[58] Field of Search ..... 75/466, 414, 460; 266/221, 268

[56] References Cited

U.S. PATENT DOCUMENTS

| | | | |
|---|---|---|---|
| 3,701,517 | 10/1972 | Gray | 266/222 |
| 5,244,489 | 9/1993 | Grenier | 75/466 |

FOREIGN PATENT DOCUMENTS

| | | |
|---|---|---|
| 0056644 | 7/1982 | European Pat. Off. . |
| 0390766 | 10/1990 | European Pat. Off. . |
| 858847 | 12/1940 | France . |
| 2070864 | 9/1971 | France . |

*Primary Examiner*—Melvyn Andrews
*Attorney, Agent, or Firm*—Young & Thompson

[57] ABSTRACT

A high-speed jet of liquid oxygen (21) with a speed higher than 100 meters per second is delivered into the tuyeres of a blast furnace of cupola furnace together with pulverised carbon. The jet reaches the opposite wall of the cavity (9) formed at the outlet of the tuyere (6) in the mass of material contained in the shaft. Supplying oxygen to the bottom of the cavity improves the burning of the remaining coal, whereby higher injection levels may be achieved. The shape of the cavity may also be altered, and, in particular, faster reactions may be achieved in the axial region of the shaft.

16 Claims, 2 Drawing Sheets

METHOD AND APPARATUS FOR INJECTING LIQUID OXYGEN

Figure 1:
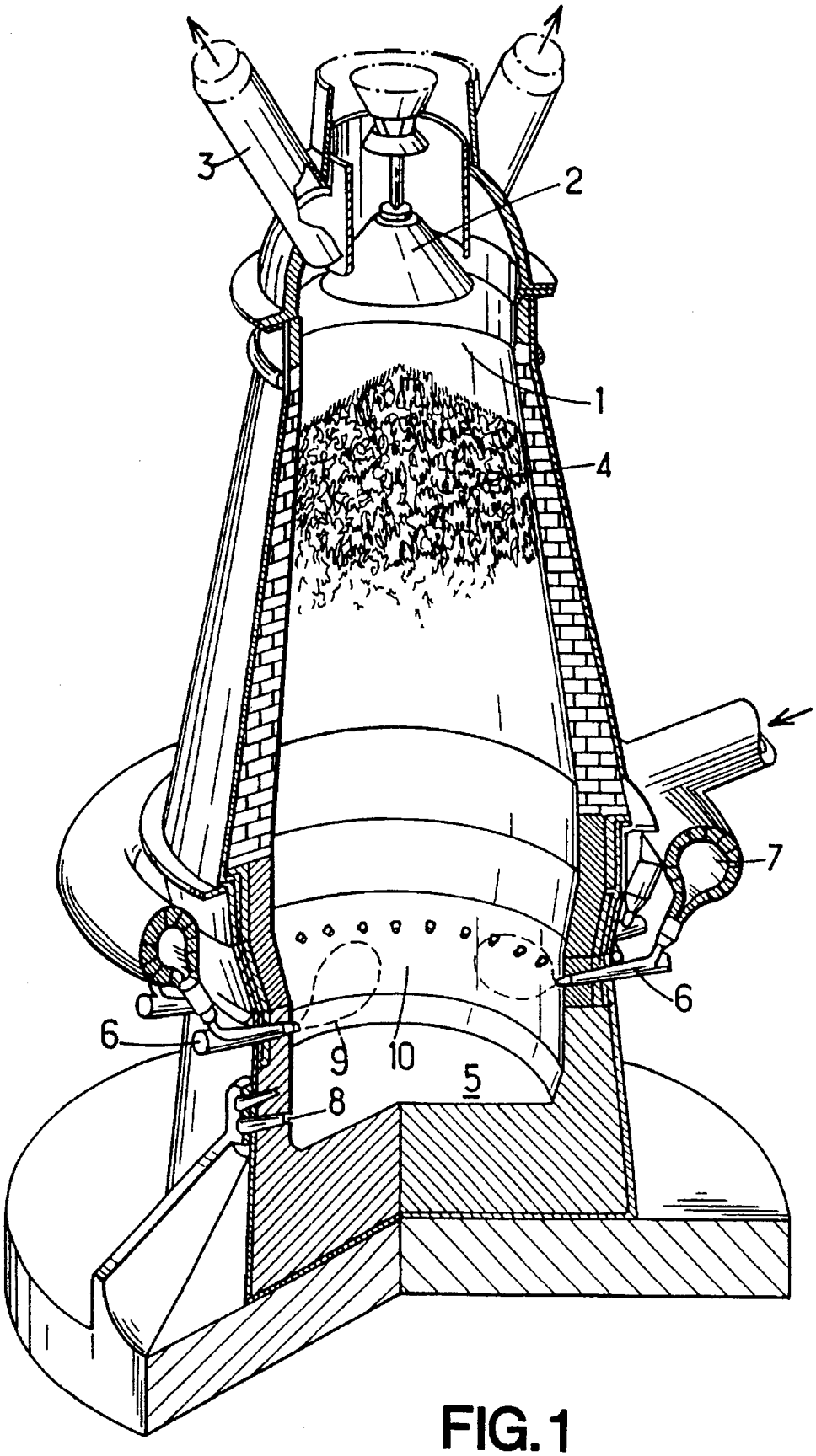

The present invention relates to a process for the injection of oxygen into a blast furnace or a cupola.

By blast furnace or cupola, is meant an apparatus comprising a more or less cylindrical chamber with a vertical axis into which is introduced from the top or throat metallic mineral and coke, the term mineral designating here any material adapted to supply, by reduction, metal and coke, and, toward the lower part of the chamber, there is introduced a gas containing oxygen, such as hot air, which, by reacting with the coke, raises the temperature of the descending mass, to reduce the mineral and form liquid metal which collects in the lower part of the chamber.

The gas containing oxygen is injected into the chamber by a series of tuyeres, which are generally regularly spaced in a horizontal circle.

The gas containing oxygen is introduced by the tuyere at a relatively high speed, and there results, in the mass of mineral and coke, the formation of a cavity whose axis, parallel to that of the tuyere adjacent the latter, then is concave upwardly. Contradictory information has been published on the more or less dense presence of pieces of coke in the cavity. It appears that they occur in low quantity and that they are continuously agitated by currents of gas.

It is known to inject, by the tuyeres, into foundry blast furnaces, carbon in addition to hot air. This injection of carbon permits diminishing the consumption of coke. To conserve good operating conditions, it is then necessary to introduce superoxygenated air through the tuyeres.

So as to improve the operation of the blast furnace, it would be desirable to be able to regulate the dimensions of the cavity. Unfortunately, the latter depends on a certain number of parameters which, by reason of other constraints, cannot as a practical matter be modified: the flow rate, the temperature and the pressure of the air are dictated by the production regime of the blast furnace, the efficiency of gasification of the coke, and the nature of the mineral to be reduced. The number of tuyeres for a given blast furnace can be changed only with great difficulty, and this number corresponds to the need for homogeneity of the distribution of the gas in the chamber. The injections of powdered carbon and oxygen through the tuyeres have the effect of decreasing the required coke charge, but are practically without effect on the dimensions of the cavity. The injection of pure oxygen permits efficacious gasification of the carbon powder, but its effect is limited by the fact that in the bottom of the cavity the atmosphere is comprised essentially of carbon monoxide ($CO_2$), practically pure, so that the non-gasified particles of carbon must recirculate within the cavity, under the influence of gas currents, so as to achieve their gasification.

The invention has for its object to provide an injection process for oxygenated gas in a blast furnace or a cupola, which permits improving the operating conditions of this blast furnace or cupola.

To obtain this result, the invention provides a process for obtaining metal in the blast furnace or cupola, according to which the mineral and the coke are introduced in the throat of the blast furnace or cupola and a gas containing oxygen is injected, with carbon, toward the lower portion of the blast furnace by tuyeres opening within the chamber of this latter, this process having the particularity that at least one portion of the oxygen is injected by the tuyere in the form of a jet of liquid oxygen at high speed.

Preferably, the speed at which the liquid oxygen leaves the tuyere is greater than 100 meters per second.

Preferably, the liquid oxygen, from a source of liquid oxygen at ambient pressure, passes through a pressurizing pump, then into a subcooling device located adjacent the blast furnace, before reaching a nozzle of a cross section calculated to transform the pressure of the liquid oxygen into velocity, this nozzle being disposed in the tuyere and coaxial with it.

The liquid oxygen injected at high speed passes at least in part through the cavity in the direction of its opposite wall, which has the effect of bringing oxygen to the bottom of the cavity, permitting the combustion of the unburned carbon as well as that of the coke. The wall of the cavity is accordingly displaced in the direction of the vertical axis of the chamber of the blast furnace or cupola, which increases the intensity of the reactions within the axial region of the mass of mineral and coke, which is called "dead man" by those in this field. If the total quantity of oxygen introduced is not changed, the vertical dimension of the cavity is reduced as a result of its greater axial extent, which is a favorable effect.

Figure 2:
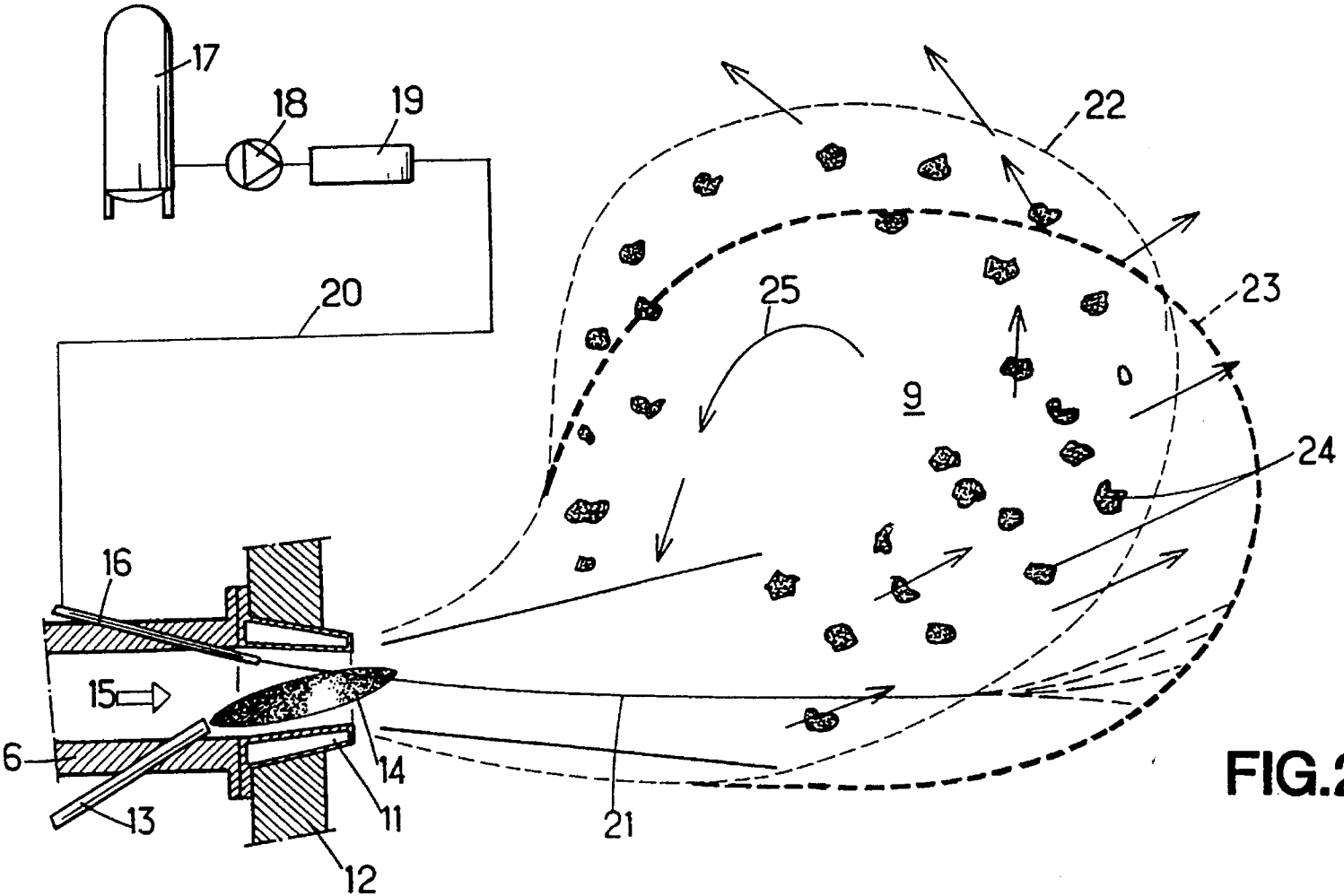

The invention will now be disclosed in greater detail with the aid of a practical example, shown by means of the figures, in which:

FIG. 1 is a schematic view of a blast furnace of conventional type, without injection of carbon and oxygen, and FIG. 2 is a view on a larger scale showing the injection of carbon and liquid oxygen.

FIG. 1 shows, as mentioned, a blast furnace of known type, with, at its upper end, the throat 1, provided with a bell 2 for introduction of mineral and coke, and conduits 3 for removing gas from the blast furnace, the chamber 4, the hearth 5, the tuyeres 6, disposed in the upper portion of the hearth, and blowing hot air brought to them by a circular conduit 7. Reference numeral 8 designates the casting hole, and there is shown at 9 in schematic fashion the cavity which forms in the mass of coke, molten metal and mineral, from each of the tuyeres 6. The central zone, located between the cavities 9, constitutes the "dead man" 10 mentioned above.

FIG. 2 shows a portion of a hot air tuyere 6, whose end 11, which in conventional manner is hollow and cooled by the circulation of water, passes through the wall 12 of the blast furnace. An injection tube 13 for pulverized carbon 14, moved by a carrier gas, which in principle is air, passes through the wall of the tuyere 6, and projects the pulverized carbon 14 into the axial portion of the flow of hot air 15 which flows from the tuyere. Reference numeral 16 indicates a liquid oxygen lance, terminating in a nozzle of small diameter, supplied by a source 17 of liquid oxygen, which is preferably of the "Oxytonne" type (registered trademark). This liquid oxygen is raised in pressure by a pressurizing pump 18, then passes through a subcooler 19, which brings its temperature to about 10° C. below its boiling point under normal conditions. The conduits 20 for transfer of the liquid oxygen are of course suitably thermally insulated. There is shown at 21, in a schematic manner, the liquid oxygen jet which leaves the injector 16. As is shown in this figure, the initial high speed of the jet 21 ensures that it keeps its cohesion to adjacent the opposite wall of the cavity 9. There is shown in fine broken lines the external shape 22 of the cavity 9 in the absence of liquid oxygen injection, whilst the curve 23, in thicker lines, shows the shape of the same cavity under the influence of projected liquid oxygen. It will be seen that the cavity becomes longer in the horizontal direction, and that, at the same time its height decreases, which corresponds to better concentration of the reaction zone.

Those skilled in the art will know that the lines 22 and 23 are approximate, that direct observation is practically impossible, and that even the shape of the cavity is not basically stable, as this latter will not be filled solely with gas, but contains also a more or less great proportion of pieces of coke 24, in the course of reduction, and which are entrained in vortex movement by the gases which circulate within the cavity, as indicated by the arrows 25.

Those skilled in the art will know that it is possible to change the shape of the cavity 9 by modifying the speed of injection of the liquid oxygen and/or the position of the injector 16, and particularly the angle that it makes relative to the axis of the tuyere 6. It is therefore possible to gain greater control of the blast furnace process, by the provision of a new parameter for which a certain latitude of variations is available.

We claim:

1. A method of operating a metal-processing furnace, comprising injecting carbon into the furnace, and simultaneously injecting into the furnace an oxygen-containing gas in liquid phase in the form of at least one coherent jet of liquid.

2. The method of claim 1, wherein the liquid jet has a speed greater than 100 m/sec.

3. The method of claim 1, and pressurizing the liquid with a pump prior to injection of the liquid into the furnace.

4. The method of claim 3, and subcooling the pressurized liquid prior to injection into the furnace.

5. The method of claim 1, and injecting also a flux of air in gaseous phase into the furnace.

6. The method of claim 1, wherein said carbon is pulverized.

7. The method of claim 6, and entraining said pulverized carbon in a flux of air in gaseous phase.

8. The method of claim 1, wherein said liquid and carbon are both introduced through a same tuyere of said furnace.

9. The method of claim 1, wherein said liquid is liquid oxygen.

10. In a metal-producing furnace having a wall and a tuyere mounted in the wall and defining a passage into the furnace; the improvement comprising means for injecting carbon through the tuyere into the furnace, and means for simultaneously injecting an oxygen-containing gas as a jet of liquid through the tuyere and into the furnace.

11. The apparatus of claim 10, wherein the tuyere is elongated and has an axis and said jet of liquid is at an acute angle to said axis.

12. The apparatus of claim 10, further comprising a thermally insulated line connecting the liquid injector to a source of liquid containing oxygen.

13. The apparatus of claim 12, and a pump in said line for increasing the pressure of said liquid.

14. The apparatus of claim 13, and a cooler for subcooling the oxygen emerging from said pump.

15. The apparatus of claim 12, and a cooler in said line for subcooling said liquid.

16. The apparatus of claim 10, wherein said liquid is liquid oxygen.

* * * * *